US007097150B2

(12) United States Patent
Sedda et al.

(10) Patent No.: US 7,097,150 B2
(45) Date of Patent: Aug. 29, 2006

(54) ELECTROMECHANICAL VALVE CONTROL ACTUATOR FOR INTERNAL COMBUSTION ENGINES AND INTERNAL COMBUSTION ENGINE EQUIPPED WITH SUCH AN ACTUATOR

(75) Inventors: Emmanuel Sedda, Sainte Honorine (FR); Christophe Fageon, Montrouge (FR); Stephane Guerin, La Gareene Colombes (FR); Jean-Paul Yonnet, Meylan (FR)

(73) Assignee: Peugeot Citroen Automobiles SA, Velizy-Villacoublay Cedex (FR)

( * ) Notice: Subject to any disclaimer, the term of this patent is extended or adjusted under 35 U.S.C. 154(b) by 0 days.

(21) Appl. No.: 10/781,610

(22) Filed: Feb. 18, 2004

(65) Prior Publication Data

US 2004/0217313 A1 Nov. 4, 2004

(30) Foreign Application Priority Data

Feb. 18, 2003 (FR) ..... 03 01950

(51) Int. Cl.
*F16K 31/02* (2006.01)
*H01F 7/00* (2006.01)
*H01F 7/08* (2006.01)

(52) U.S. Cl. ..... 251/129.16; 251/129.01; 335/229

(58) Field of Classification Search ..... 251/129.01, 251/129.09, 129.1, 129.15, 129.16, 129.18; 123/90.11; 335/229, 230, 231, 232, 233, 335/234

See application file for complete search history.

(56) References Cited

U.S. PATENT DOCUMENTS

| | | | | |
|---|---|---|---|---|
| 3,858,135 A | | 12/1974 | Gray | |
| 4,533,890 A | | 8/1985 | Patel | |
| 4,574,841 A | * | 3/1986 | Hugler | 137/625.44 |
| 4,664,150 A | * | 5/1987 | Steiger | 137/625.27 |
| 4,715,332 A | | 12/1987 | Kreuter | |
| 4,883,025 A | * | 11/1989 | Richeson, Jr. | 123/90.11 |
| 5,161,779 A | * | 11/1992 | Graner et al. | 251/129.16 |
| 5,188,336 A | * | 2/1993 | Graner et al. | 251/129.16 |
| 6,198,370 B1 | | 3/2001 | Schmitz | |
| 6,216,653 B1 | | 4/2001 | Okada et al. | |
| 6,308,667 B1 | | 10/2001 | Hong et al. | |

FOREIGN PATENT DOCUMENTS

| | | |
|---|---|---|
| DE | 35 00 530 A | 7/1986 |
| DE | 100 03 928 A | 6/2001 |
| EP | 0 422 228 A | 4/1991 |
| EP | 0 504 806 A | 9/1992 |
| EP | 0 816 644 A | 1/1998 |
| EP | 1 010 866 A | 6/2000 |
| EP | 1 174 595 A | 1/2002 |
| EP | 1 174 596 A | 1/2002 |
| EP | 1 264 969 A | 12/2002 |
| FR | 2 784 497 A | 4/2000 |
| FR | 2 822 585 A | 9/2002 |
| JP | 10 047028 A | 2/1998 |
| JP | 2001 035721 A | 2/2001 |
| JP | 2002 130510 A | 5/2002 |

* cited by examiner

*Primary Examiner*—Edward K. Look
*Assistant Examiner*—John K. Fristoe, Jr.
(74) *Attorney, Agent, or Firm*—RatnerPrestia

(57) ABSTRACT

An electromechanical valve control actuator for internal combustion engines, includes an electromagnet with a magnet and a mobile magnetic plate moving into the vicinity of the electromagnet. The magnet is located on a surface of the electromagnet opposite the plate. The actuator includes an E-shaped magnetic circuit, and the magnet is located at the end of a branch of this E-shaped circuit.

10 Claims, 4 Drawing Sheets

ELECTROMECHANICAL VALVE CONTROL ACTUATOR FOR INTERNAL COMBUSTION ENGINES AND INTERNAL COMBUSTION ENGINE EQUIPPED WITH SUCH AN ACTUATOR

FIELD OF THE INVENTION

The present invention pertains to an electromechanical valve control actuator for internal combustion engines and to an internal combustion engine equipped with such an actuator.

BACKGROUND

An electromechanical actuator 100 (FIG. 1) for a valve 110 comprises mechanical means, such as springs 102 and 104, and electromagnetic means, such as electromagnets 106 and 108, for controlling the position of the valve 110 by means of electric signals.

The rod of the valve 110 is applied for this purpose against the rod 112 of a magnetic plate 114 located between the two electromagnets 106 and 108.

When current flows in the coil 109 of the electromagnet 108, the latter is activated and generates a magnetic field attracting the plate 114, which comes into contact with it.

The simultaneous displacement of the rod 112 enables the spring 102 to bring the valve 110 into the closed position, the head of the valve 110 coming into contact with the seat 111 and preventing the exchange of gas between the interior and the exterior of the cylinder 117.

Analogously (not shown), when a current flows in the coil 107 of the electromagnet 106, the electromagnet 108 being deactivated, and it is activated and it attracts the plate 114, which comes into contact with it and displaces the rod 112 by means of the spring 104 in such a way that this rod 112 acts on the valve 110 and brings the latter into the open position, the head of the valve being moved away from its seat 111 to permit, for example, the admission or the injection of gas into the cylinder 117.

Thus, the valve 110 alternates between the open and closed positions, the so-called switched positions, with transient displacements between these two positions. The open or closed state of a valve will hereinafter be called the "switched state."

The actuator 100 may also be equipped with a magnet 118, which is located in the electromagnet 108, and with a magnet 116, which is located in the electromagnet 106, the magnets being intended to reduce the energy necessary for maintaining the plate 114 in a switched position.

Each magnet is located for this purpose between two subelements of the electromagnet with which it is associated in such a way that its magnetic field, possibly combined with the field generated by the electromagnet, supports the maintenance of the valve 110 in the open or closed position. For example, the magnet 116 is located between two subelements $\mathbf{106}_a$ and $\mathbf{106}_b$.

Due to the action of the magnet on the magnetic plate, such an electromagnet 106 or 108, called an electromagnet with magnet or polarized electromagnet, requires considerably less energy for controlling a valve, as the maintenance of a valve in a switched position represents a considerable energy consumption for the actuator.

The present invention results from the observation that the actuator 100 has numerous drawbacks.

In fact, this actuator requires the use of two distinct subelements 106*a* and 106*b* to form an electromagnet 106.

Operations peculiar to the manufacture and the stocking of each of these subelements are therefore necessary, which increases the complexity and the manufacturing costs of the actuator.

Moreover, the operation required for assembling these subelements 106*a* and 106*b* with the magnet 116 increases the cost and the complexity of the manufacture of the actuator, and there is a risk during this assembly that the subelements 106*a* and 106*b* and/or the magnet 116 may be assembled incorrectly or that they will be damaged, which would reduce the performance of the electromagnet.

A new drawback is the difficulty of a possible replacement of a magnet 116 or 118. In fact, it is necessary to disassemble the electromagnet unit 106 to replace a defective magnet 116.

Another drawback is the considerable size of the actuator 100, which is due especially to the fact that its height h is dictated by the cross section Sa of the magnets 116 and 118. This cross section Sa is, in fact, considerable in order to obtain a high magnetic flux from these magnets.

In addition, such an actuator has a considerable leakage due to the dispersion of the magnetic flux in the air gaps.

The actuator 100 also requires the use of a magnetic plate 114 of a large mass due especially to its considerable cross section Sp. In fact, this cross section is, in general, equal to the cross section $S_e$ of the branches of the electromagnet to achieve optimal functioning of the actuator, as the branches of the support of the electromagnet and the plate form a magnetic circuit of constant cross section.

However, the use of a plate 114 of a considerable cross section and consequently of a large mass has numerous drawbacks, which were described above.

First, the actuator 100 requires springs of high rigidity to displace the considerable mass of the plate. Consequently, the sensitivity of the control exerted by the electromagnets on the plate by means of the current flowing in the coils is reduced, while the consumption required by the electromagnet for controlling the plate is increased.

The use of springs of increased rigidity causes, as a corollary, the latter to form an oscillating device with the mobile elements of the actuator 100, which said device is characterized by a switching time that is fixed more or less by the rigidity $k_{102}$ and $k_{104}$ of the springs 102 and 104 and by the mass $m_d$ of the elements being displaced (plate 114, rod 112, mobile mass of the springs 102 and 104, and valve 110).

Second, the energy lost, e.g., in the form of the operating noise of the actuator due to the impact of the plate on the electromagnet is generally increased by an increase in the mass of the plate. Such an increase in the energy loss causes a lower energy efficiency of the actuator.

SUMMARY OF THE INVENTION

The present invention remedies at least one of the above-mentioned drawbacks. It pertains to an electromechanical valve control actuator for internal combustion engines, comprising an electromagnet with a magnet and a mobile magnetic plate that moves into the vicinity of the electromagnet, the magnet being located on a surface of the electromagnet opposite the plate, characterized in that the electromagnet comprises an E-shaped magnetic circuit, and the magnet is located at the end of a branch of this E-shaped circuit.

The manufacture and the assembly of a polarized electromagnet are facilitated by the present invention because the magnet is fixed on the surface of this electromagnet, while it is no longer necessary to use an electromagnet formed by a plurality of subelements, which simplifies the manufacturing, logistic and assembly operations necessary for the electromagnet.

According to a variant, a rod is an integral part of the plate, the rod being located outside the E-shaped circuit.

In this case, different support branches are equipped with a magnet according to one embodiment.

According to one embodiment, at least one magnet has a cross section that is larger than the cross section of the branch on which it is located.

According to one embodiment, the plate has a cross section that is smaller than the cross section of the end branches of the E-shaped support.

According to one embodiment, the cross section of an end branch of the support is smaller than half the cross section of the central branch of the support.

In one embodiment, the cross section of the junction between an end branch of the support and the central branch of the E-shaped support is smaller than half the cross section of the central branch of the support.

By fixing the magnet on the support of the electromagnet, the action of this magnet on the plate is also increased in relation to an analogous magnet incorporated in the body of the electromagnet, i.e., a magnet located at a greater distance from the plate.

The present invention also pertains to an internal combustion engine comprising an electromechanical valve control actuator equipped with an electromagnet with a magnet and with a mobile magnetic plate that moves into the vicinity of the electromagnet. According to the present invention, the actuator of the engine is according to one of the above-described actuator embodiments.

BRIEF DESCRIPTION OF THE DRAWINGS

Other characteristics and advantages of the present invention will become apparent from the description of the present invention, which will be given below as a nonlimiting example with reference to the drawings attached, in which.

DETAILED DESCRIPTION

Figure 1:
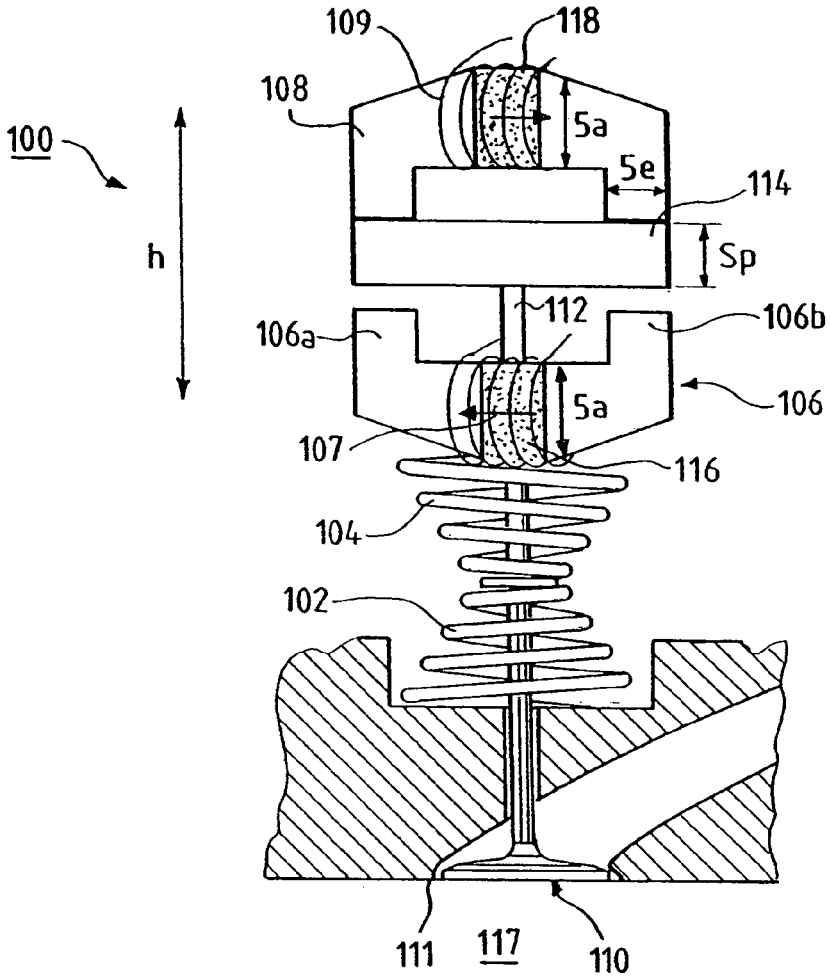
FIG 1 (Prior Art)
FIG. 1, which was already described, shows a prior-art polarized actuator.
Figure 2:
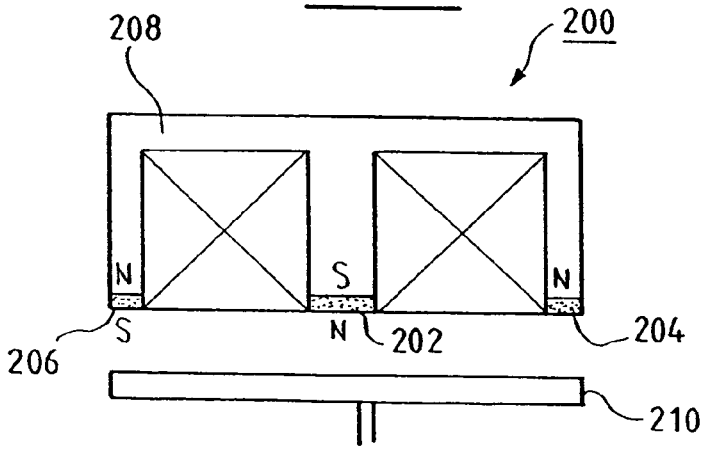
FIGS. 2 through 8 show actuators with polarized electromagnets according to the present invention.

FIG. 2 shows an electromagnet 200 comprising three magnets 202, 204 and 206, which are located, according to the present invention, on the surface of the support 208 opposite the plate 210 of the actuator.

More precisely, the magnets 202, 204 and 206 are located, respectively, on the central branch and the end branches of the E-shaped support 208.

The magnets are arranged, as a function of their polarity, such that their magnetic fields support the magnetic field generated by the electromagnet 200 when the latter is active and attracts the plate 210.

In the example given, the north pole (N) of the magnet 202 and the south poles (S) of the magnets 204 and 206 point toward the plate 210.

Such an electromagnet 200 consequently requires an E-shaped support 208, as is used in the conventional manner for nonpolarized actuators.

In fact, the manufacture of such an E-shaped support is easy because it is formed by a single block. Moreover, the fixation on the support 208 of the magnets 202, 204 and 206 is simplified because it requires only that the magnet be maintained on a surface of the support.

It should be stressed for this purpose that a magnet may be fixed on its support by bonding or integral molding. In this case, the magnetization of the magnet may be carried out subsequent to the integral molding in order to eliminate the risk of demagnetization of the magnet during this integral molding.

Figure 9A:
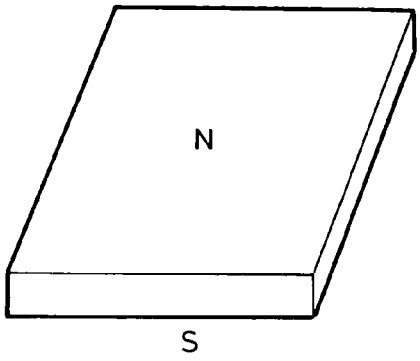
FIGS. 9*a* and 9*b* show different magnets that can be used according to the present invention.
Figure 9B:
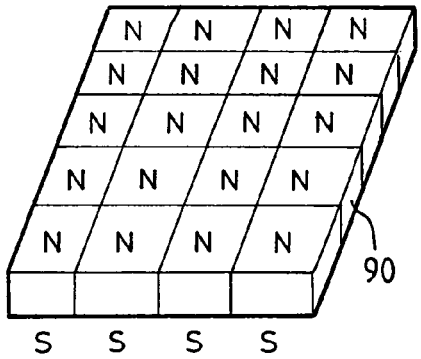

It should also be pointed out that the magnet may be in one piece (FIG. 9*a*) or formed by the assembly of small juxtaposed magnets 90 (FIG. 9*b*). In the latter case, if the magnet is a conductor, which is the case with rare earth magnets, the intensity of the currents induced in the magnet during the operation of the actuator is reduced, which thus leads to an increase in the efficiency of the actuator.

According to one variant, the magnet is composed of a magnet powder and a binder. It will thus have a low resistivity, which reduces the intensity of the currents induced during the operation of the actuator.

By maintaining a magnet in the proximity of the magnetic plate, the leakage of the flux of the magnet is reduced, which thus improves the operation of the actuator.

Figure 3:
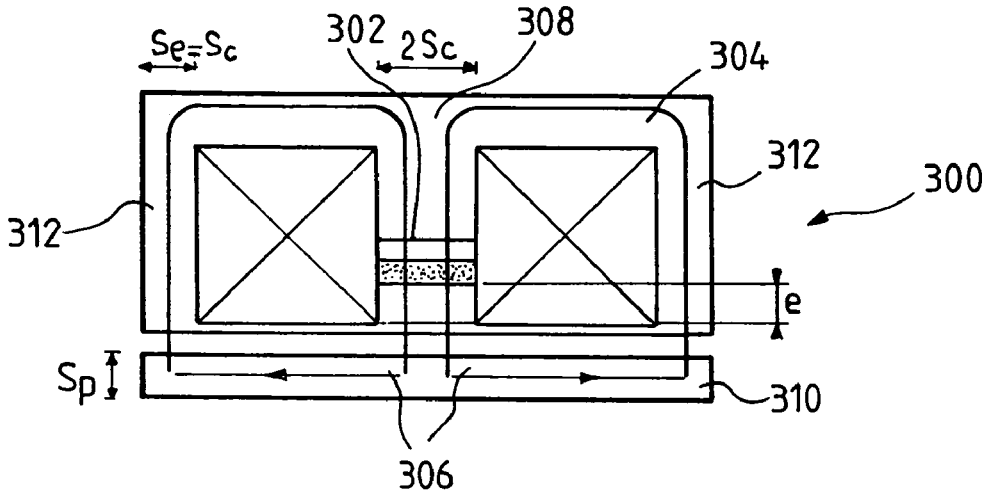

FIG. 3 shows a second electromagnet 300, in which a single magnet 302 is located on the surface of its support 304.

This support 304 may be machined so as to maintain a residual air gap e between the surface of the magnet and the plate 310 when the latter comes into contact with the support, thus eliminating the shocks between the magnet 302 and the plate. The more fragile the magnet, e.g., if it is made of rare earths, the more advantageous such an air gap protecting the magnet is.

As is shown in the same FIG. 3, the flux of the magnetic field generated by the electromagnet forms two symmetrical loops 306 joining each other in the central column 308. In fact, the two ends 312 of the support 304 have a cross section $S_e$ equaling half the cross section $2S_c$ of the central column in order to attain an identical saturation level at any point of the magnetic circuit formed by the central column 308 and by the two ends 312 of the support 304.

Figure 4:
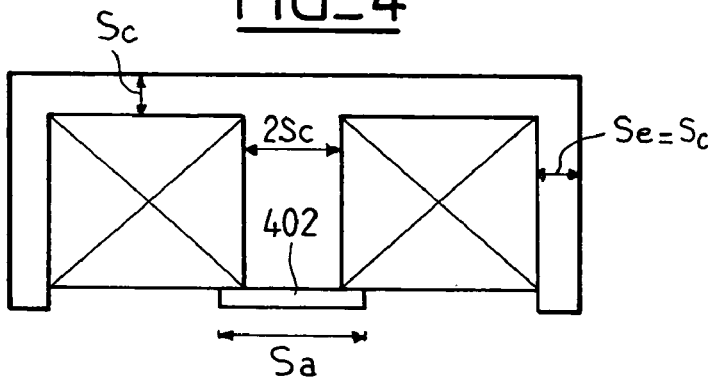

FIG. 4 shows a third electromagnet 400 according to the present invention, comprising a single central magnet 402 of a cross section $S_a$ that is larger than the cross section $S_c$ of the magnetic circuit formed by the magnetic plate (not shown) and the branches of the support 404. Such a magnet generates a stronger magnetic field than a magnet of a smaller cross section.

Figure 5:
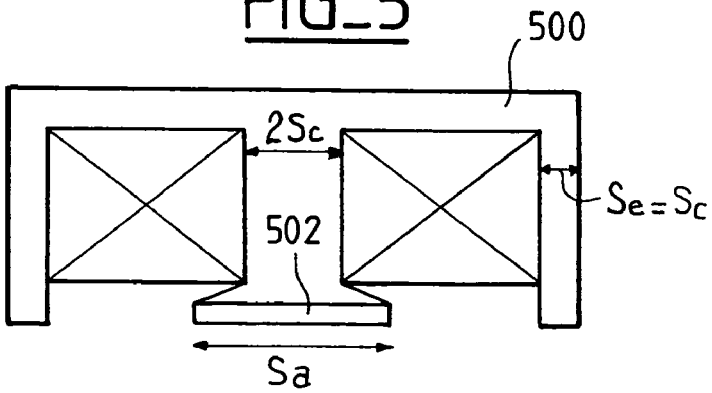

FIG. 5 shows another variant of the electromagnet 500, using a central magnet 502 of a cross section $S_a$ larger than the cross section $S_c$ of the magnetic circuit. This configuration makes it possible to increase the polarization flux generated by the magnet, particularly in the plate (not shown) and in the end columns of the magnetic circuit.

Figure 8:
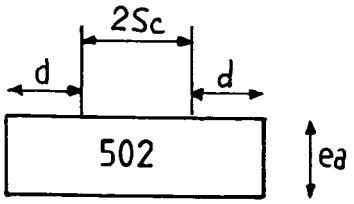

It was empirically established that, as is shown in FIG. 8, the optimal use of the magnet requires that the displacement d of the magnet 502 in relation to the cross section $S_c$ of the magnetic circuit be smaller than the thickness $e_a$ of the magnet.

If the remanent flux density of a magnet is lower than the saturation induction of the magnetic plate, the cross section of the latter can be reduced without limiting the permanent force of attraction exerted by the device on this plate.

The thickness of the plate was reduced empirically by a factor of 1.6 when the plate had a saturation threshold of 2 Tesla and a magnet with a remanent field of 1.2 Tesla was used.

Such a reduction of the mass of the plate makes it possible to reduce the mass displaced during the switchings of the valve, which has numerous advantages.

Thus, the energy loss generated by the shocks of the plate against the electromagnet is reduced, improving the efficiency of the actuator.

Moreover, it is possible to use springs of a low rigidity to control a plate of a limited mass. Consequently, the power consumption is reduced.

As a corollary, the control exerted by the electromagnet on the plate by means of the field generated by a coil is increased because the control exerted by the springs is reduced in intensity. Such an improvement in control makes it possible, for example, to reduce the velocity of impact of the plate on the support of the electromagnet.

Finally, the manufacturing cost of the plate is reduced, while the size of the electromagnet is no longer dictated in terms of height by the cross section of the magnet.

The E-shaped electromagnets shown in FIGS. 2, 3, 4 and 5 form a magnetic circuit comprising a central branch, of a cross section of $2S_c$, and two end branches of a cross section of $S_c$.

Due to this optimal arrangement, the magnetic plate has, in addition, a cross section $S_p$ equal to this cross section $S_c$ of the magnetic circuit, as is shown in FIG. 3.

However, the force exerted by the polarized electromagnet on the plate can be increased by concentrating the magnetic flux generated by this electromagnet. For example, the cross section of the end branches 606 of the support 602 (FIG. 6) of an electromagnet 600 with a magnet 604 can be reduced.

In other words, by reducing the cross section $S_e<S_c$ of the ends while the cross section $2S_c$ of the central branch is maintained, the magnetic induction is increased in these ends, and such an increase in induction does not have to saturate the branches.

It was empirically established that the remanent flux density of a magnet, on the order of magnitude of 1.2 to 1.4 Tesla for a neodymium-iron-boron magnet, was lower than the saturation induction of the ends, which was on the order of magnitude of 2 Tesla.

Consequently, it was possible to reduce the cross sections of the ends without saturation of the latter.

The flux concentration makes it possible to achieve considerable magnetization in the air gap with the use of magnets with low remanent flux density, for example, magnets made of ferrite or composites.

If rare earth magnets are used, the exterior branch may have a cross section that is smaller by one third than the cross section of the central branch (or column).

It should be pointed out that it is analogously possible to concentrate the magnetic flux generated by the electromagnet 600 by increasing the cross section $S_c$ of the central branch of the support and/or by reducing the cross section $S_e$ of the end branches 606.

To avoid shocks between the plate 710 (FIG. 7) and the magnet 702 of the electromagnet 700, it is possible to use a support 704 that ensures the maintenance of an air gap e between the magnet 702 and the plate 710 when the latter comes into contact with the support.

Figure 6:
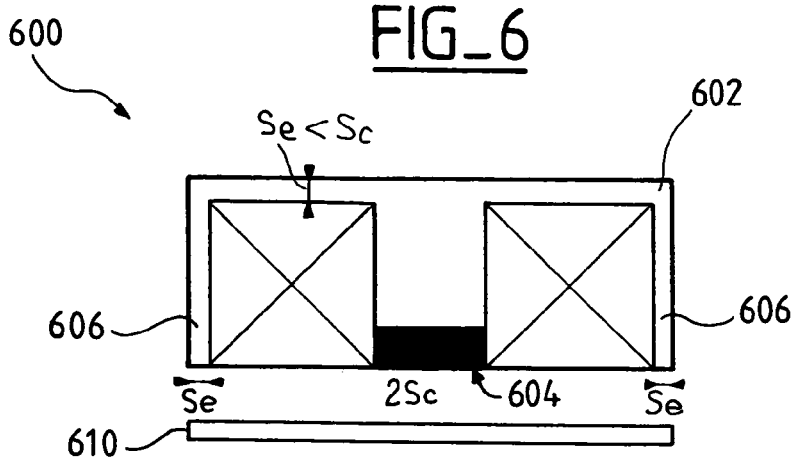
Figure 7:
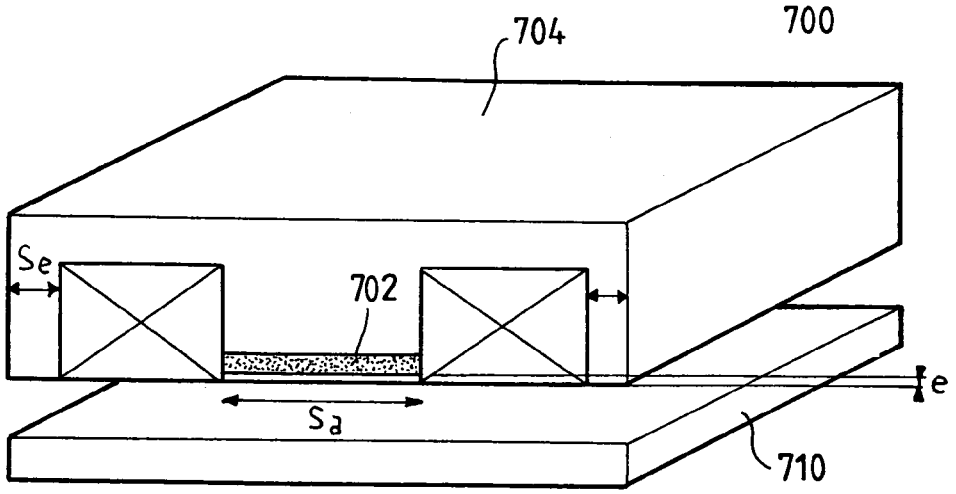

Moreover, as is shown in FIGS. 6 and 7, it is also possible to concentrate the flux of the magnetic field in the support 704 by reducing the cross section $S_e$ of the end branches of the electromagnet, this section being smaller than half the cross section $2S_c$ of the central column.

The present invention may have numerous variants. In fact, it may be possible to magnetically saturate the plate by reducing its cross section if the action on the plate is sufficient to ensure that it is maintained against the electromagnet.

Figure 10A:
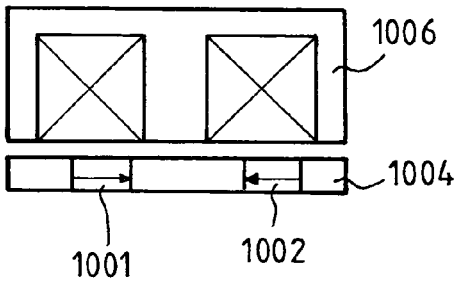
FIGS. 10*a*, 10*b* and 10*c* show variants of the present invention.
Figure 10B:
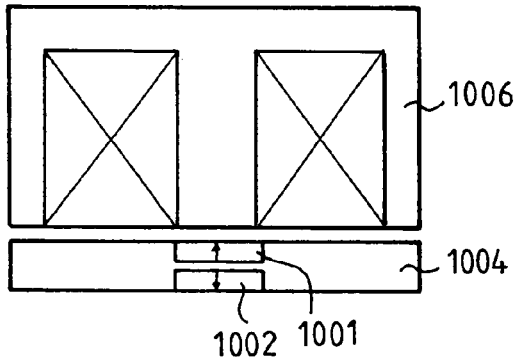
Figure 10C:
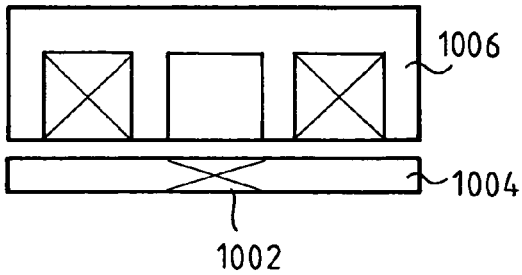

According to the variants of the present invention as shown in FIGS. 10*a*, 10*b* and 10*c*, magnets 1001 and 1002 may be arranged on a surface of the mobile plate 1004 controlled by the electromagnet 1006.

The use of the present invention also makes it possible to use an inlet valve actuator different from an exhaust valve actuator.

In fact, it is known that an inlet valve requires an actuator of a lower power than does an exhaust valve.

Nevertheless, the functioning of a cold inlet valve actuator, i.e., for the first switchings, does require a power comparable to that required by an exhaust valve actuator because problems with the plate sticking to the electromagnet make the first cold switchings more difficult.

An inlet valve actuator according to the present invention has a better performance for maintaining the valve in the cold state than a prior-art actuator due to the optimized action of the magnet on the plate.

Consequently, the dimensions of an inlet valve actuator can be reduced, which leads to the saving of space and mass for the engine.

What is claimed is:

1. Electromechanical valve control actuator for internal combustion engines, comprising an electromagnet with a magnet and with a mobile magnetic plate moving into the vicinity of the electromagnet, the magnet being located on a surface of the electromagnet opposite the plate, wherein the electromagnet comprises a E-shaped magnetic circuit, and the magnet is located at the end of a branch of the E-shaped circuit, wherein a plurality of branches of the E-shaped magnetic circuit are equipped with a respective plurality of magnets.

2. Actuator in accordance with claim 1, wherein at least one of the magnets has a cross section larger than a cross section of the branch on which the at least one magnet is located.

3. Actuator in accordance with claim 1, further comprising a rod that is an integral part of the plate, the rod being located outside the E-shaped circuit.

4. Electromechanical valve control actuator for internal combustion engines, comprising an electromagnet with a magnet and with a mobile magnetic plate moving into the vicinity of the electromagnet, the magnet being located on a surface of the electromagnet opposite the plate, wherein the electromagnet comprises a E-shaped magnetic circuit, and the magnet is located at the end of a branch of the E-shaped circuit, wherein the cross section of an end branch of the circuit is smaller than half the cross section of a central branch of the circuit.

5. Actuator in accordance with claim 4, further comprising a rod that is an integral part of the plate, the rod being located outside the E-shaped circuit.

6. Internal combustion engine comprising an electromechanical valve control actuator in accordance with claim 4.

7. Electromechanical valve control actuator for internal combustion engines, comprising an electromagnet with a magnet and with a mobile magnetic plate moving into the vicinity of the electromagnet, the magnet being located on a surface of magnetic circuit, and the magnet is located at the end of a branch of the E-shaped circuit, wherein a cross section of a junction between an end branch of the E-shaped circuit and a central branch of the E-shaped circuit is smaller than half the cross section of the central branch of the circuit.

8. Electromechanical valve control actuator for internal combustion engines, in accordance to claims 1, 4, or 7, wherein the plate has a cross section that is smaller than a cross section of the end branches of the E-shaped circuit.

9. Actuator in accordance with claim 8, further comprising a rod that is an integral part of the plate, the rod being located outside the E-shaped circuit.

10. Electromechanical valve control actuator for internal combustion engines, comprising an electromagnet with a magnet and with a mobile magnetic plate moving into the vicinity of the electromagnet, the magnet being located on a surface of the electromagnet opposite the plate, wherein the electromagnet comprises a E-shaped magnetic circuit, and the magnet is located at the end of a branch of the E-shaped circuit, and wherein a magnetic circuit formed by a central branch, an end branch of the E-shape magnetic circuit, and a junction between this central branch and this end branch is open when the electromagnet does not generate a magnetic field.

* * * * *